US009356376B2

(12) United States Patent
Joschika

(10) Patent No.: US 9,356,376 B2
(45) Date of Patent: May 31, 2016

(54) MINIATURIZED CONNECTOR

(75) Inventor: Thomas Joschika, Braedstrup (DK)

(73) Assignee: ESTRON A/S, Them (DK)

( * ) Notice: Subject to any disclaimer, the term of this patent is extended or adjusted under 35 U.S.C. 154(b) by 0 days.

(21) Appl. No.: 14/402,642

(22) PCT Filed: May 31, 2012

(86) PCT No.: PCT/EP2012/060251

§ 371 (c)(1),
(2), (4) Date: Nov. 20, 2014

(87) PCT Pub. No.: WO2013/178267

PCT Pub. Date: Dec. 5, 2013

(65) Prior Publication Data

US 2015/0340820 A1 Nov. 26, 2015

(51) Int. Cl.

| | |
|---|---|
| ***H01R 24/00*** | (2011.01) |
| ***H01R 13/17*** | (2006.01) |
| ***H01R 13/187*** | (2006.01) |
| ***H01R 13/639*** | (2006.01) |
| ***H01R 24/58*** | (2011.01) |
| ***H01R 13/627*** | (2006.01) |
| *H01R 105/00* | (2006.01) |

(52) U.S. Cl.

CPC ..... *H01R 13/17* (2013.01); *H01R 13/187* (2013.01); *H01R 13/6277* (2013.01); *H01R 13/639* (2013.01); *H01R 24/58* (2013.01); *H01R 2105/00* (2013.01)

(58) Field of Classification Search

CPC ..... H01R 24/58
USPC ..... 439/668, 669, 675
See application file for complete search history.

(56) References Cited

U.S. PATENT DOCUMENTS

| | | | | | |
|---|---|---|---|---|---|
| 1,014,718 | A * | 1/1912 | Parsons | H01R 31/06 | 439/281 |
| 2,022,669 | A * | 12/1935 | Keefe | H01R 13/20 | 379/316 |
| 2,576,174 | A * | 11/1951 | Denine | H01R 24/58 | 439/668 |
| 2,619,515 | A * | 11/1952 | Doane | H01R 13/4536 | 174/167 |
| 3,279,835 | A * | 10/1966 | Krohm | F16B 7/0413 | 285/321 |
| 3,750,094 | A * | 7/1973 | Zenkich | A61B 5/0416 | 24/676 |
| 4,072,386 | A * | 2/1978 | Wallo | H01R 24/40 | 439/349 |
| 4,165,147 | A * | 8/1979 | Buck | H01R 24/58 | 439/188 |

(Continued)

FOREIGN PATENT DOCUMENTS

| | | |
|---|---|---|
| JP | S5920580 U | 2/1984 |
| JP | H05205840 | 8/1993 |

(Continued)

OTHER PUBLICATIONS

International Search Report and Written Opinion for PCT:EP2012:060251, filed Jan. 21, 2013.

(Continued)

*Primary Examiner* — Neil Abrams
(74) *Attorney, Agent, or Firm* — Brinks Gilson & Lione

(57) ABSTRACT

A miniaturized connector is provided. The connector comprises a plug and a receptacle, where the receptacle is adapted for being assembled into a device, e.g. ear piece, ear monitor or other parts, and the plug is via a cable connected to a source for electrical power. Contact springs may be formed to protrude through the receptacle housing opening in straight lines to engage a plug recess to secure the plug.

16 Claims, 6 Drawing Sheets

(56) References Cited

U.S. PATENT DOCUMENTS 4,420,216 A * 12/1983 Motoyama ..... G11B 31/00 439/188
4,583,797 A * 4/1986 Engelmore ..... H01R 39/64 439/22
4,695,116 A * 9/1987 Bailey ..... H01R 24/58 200/51.1
4,743,205 A * 5/1988 Mitani ..... H01R 24/50 439/63
5,018,044 A * 5/1991 Weiss ..... A61N 1/14 361/212
5,147,221 A * 9/1992 Cull ..... H01R 24/40 439/585
5,188,540 A * 2/1993 Haertl ..... H01M 2/1044 439/500
5,190,474 A * 3/1993 Ginet ..... H01R 24/50 439/581
5,376,022 A * 12/1994 Carr ..... H01R 24/38 439/668
5,474,476 A * 12/1995 Cheng ..... H01R 24/40 439/675
5,717,771 A * 2/1998 Sauer ..... H04R 25/55 381/312
6,126,465 A * 10/2000 Franks, Jr. ..... H01R 24/58 439/218
6,692,285 B2 * 2/2004 Islam ..... H02G 3/0691 439/352
6,718,113 B2 * 4/2004 Mine ..... G02B 6/3825 385/139
6,860,761 B2 * 3/2005 Lee ..... H01R 4/28 439/582
6,869,301 B2 * 3/2005 Shimizu ..... H01R 13/6276 439/324
6,893,291 B2 * 5/2005 Wendling ..... H01R 9/0518 439/582
7,056,127 B2 * 6/2006 Suzuki ..... H01R 13/6205 439/22
7,175,478 B2 * 2/2007 Ollivier ..... H01R 13/5224 439/669
7,445,515 B1 11/2008 Yuan et al.
7,785,127 B2 * 8/2010 Nagamine ..... H01R 13/6277 439/347
7,955,111 B2 * 6/2011 Costabel ..... F16B 5/0628 439/287
8,313,336 B2 * 11/2012 Bondo ..... H01R 13/26 439/324
8,814,600 B2 * 8/2014 Watanabe ..... H01R 13/6666 439/620.09
2007/0281550 A1 12/2007 Chien et al.
2009/0286427 A1 11/2009 Bolin et al.
2015/0340820 A1 * 11/2015 Joschika ..... H01R 13/17 439/669

FOREIGN PATENT DOCUMENTS

JP H09326278 12/1997
JP 2009104867 5/2009

OTHER PUBLICATIONS

Preliminary Report on Patentability for PCT:EP2012:060251, issued Dec. 2, 2014.
I Japanese Office Action for application 2015-514359, drafted Nov. 19, 2015.

* cited by examiner

MINIATURIZED CONNECTOR

RELATED APPLICATIONS

This application claims the benefit under 35 U.S.C. §371 of International Patent Application No. PCT/EP2012/060251, having an international filling date of May. 31, 2012, the contents of which are incorporated herein by reference in their entirety.

The invention relates to a miniaturized connector mainly for the audio industry. The connector comprises a plug and a receptacle, where the receptacle is adapted for being assembled into a device, e.g. ear piece, ear monitor or other parts, and the plug is via a cable connected to a source for electrical power.

BACKGROUND

Electrical connectors are used almost in every possible industry, where two objects need to be electrically connected. In applications, e.g. hearing aids, ear monitors used in the security, TV, and music industry and similar, where space and appearance are of big importance and the size of the electrical connectors needs to be small in order to fit into e.g. electrical devices.

Examples of such connectors are the commonly known micro jack connectors, which are used in e.g. cell phones, mp3 players or the like for connecting earphones with the device. The micro jack connectors comprise a plug with a set of contact points, typically three contact points, and a receptacle (mounted in e.g. the cell phone or the mp3 player) having a matching set of contact points each being in electrical contact with one corresponding electrical contact point on the plug, when the plug is inserted in the receptacle.

The outer diameter of the plug in micro jack connectors is often on the order of 2-3 mm and the length of the plug is on the order of 1-3 cm.

The construction of these commonly known micro jack connectors makes it rather difficult to reduce their size further.

DESCRIPTION OF THE INVENTION

Disclosed herein is a receptacle for a miniaturized connector for use in an audio device, a hearing device or a similar device, wherein the receptacle comprises a first female receptacle part comprising a first contact spring and a housing part, the housing part having a first recess adapted to contain the first contact spring; and a first male receptacle part situated inside the first female receptacle part.

Provision of the male receptacle part inside the female receptacle as compared to the known micro-jack connectors, which have no inner contacts, allows for a reduction in size of the receptacle with a factor of 2-3 times. This is significant when incorporating a receptacle in an audio device, a hearing device or a similar device, where size is a major factor, and a reduction of just 50% in size makes a large difference.

Further, the contact spring of the invention is simple and provides both an electrical contact function between the receptacle and a plug and further has a locking function, as it secures a plug part in the receptacle.

In one or more embodiments, the receptacle according to the invention further comprises a second contact spring, wherein the housing part comprises a second recess adapted to contain the second contact spring. The second spring has a similar function as the first contact spring.

In one or more embodiments, the first contact spring and/or the second contact spring have at least one bend.

In one or more embodiments, the first contact spring and/or the second contact spring only have one bend. This provides for a very simple and inexpensively producible contact spring.

Disclosed herein is further a plug for a miniaturized connector for use in an audio device, a hearing device or a similar device, wherein the plug comprises a first male plug part; and a first female plug part situated inside the first male plug part, the first male plug part comprising a recess adapted to secure the plug inside a corresponding receptacle.

Provision of the female plug part inside the male plug part as compared to the known micro-jack connectors, which only have male part plug parts, allows for a reduction in size of the plug with a factor of 2-3 times. This is significant when incorporating a plug in an audio device, a hearing device or a similar device, where size is a major factor, and a reduction of just 50% in size makes a large difference.

Further, the recess allows for a contact spring in a receptacle to make an electrical contact between the receptacle and a plug and further has the function of providing a location for a contact spring of a receptacle to lock the plug inside the receptacle.

In one or more embodiments, the plug further comprises a first insulator placed between the first female plug part and the first male plug part thereby preventing electrical contact between the two plug parts.

In one or more embodiments, the plug further comprises a cable with at least a first wire and a second wire, wherein the first wire is connected to the first female plug part and a second wire connected to the first male plug part.

In one or more embodiments, the first wire and the second wire are litz wires.

In one or more embodiments, the cable further comprises a strength member and a jacket, wherein the jacket surrounds the at least first and second wires and the strength member.

In one or more embodiments, the plug further comprises a second male plug part and a second insulator placed between the first male plug part and the second male plug part preventing electrical contact between the two male plug parts.

In one or more embodiments, the cable further comprises a third wire, wherein the first wire is connected to the second male plug part.

Disclosed herein is also a miniaturized connector suitable for use in a device, which requires connectors of a size smaller than the commonly known micro jack connectors, i.e. a device such as an audio device, a hearing device or a similar device wherein when the connector is assembled; the first female plug part is in electrical contact with the first male receptacle part situated inside the first female receptacle part; and the first male plug part is in electrical contact with the first contact spring.

In one or more embodiments, the plug comprises the second male plug part and the receptacle comprises the second contact spring, wherein, when the connector is assembled, the second male plug part is in electrical contact with the second contact spring.

DETAILED DESCRIPTION OF THE DRAWINGS

Figure 1:
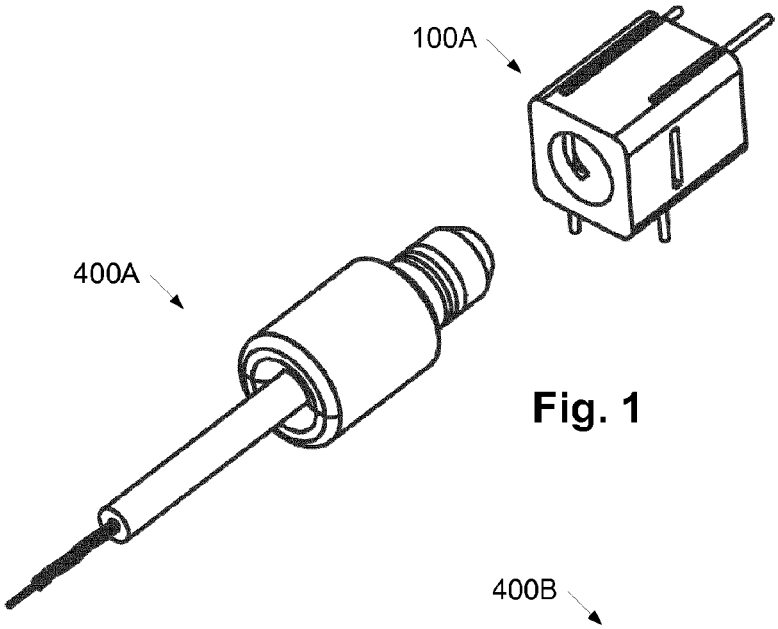
FIG. 1 shows a first embodiment of the connector.
Figure 2:
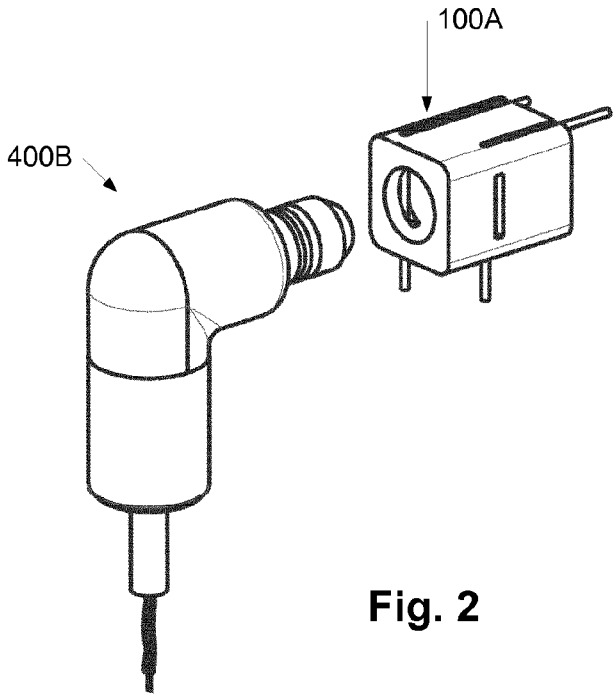
FIG. 2 shows a second embodiment of the connector.
Figure 3:
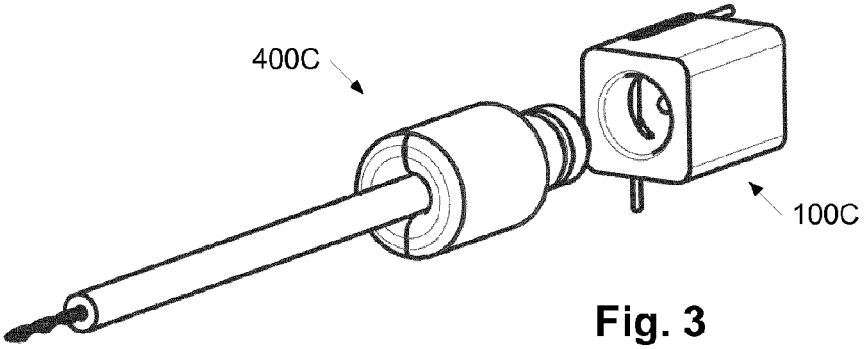
FIG. 3 shows a third embodiment of the connector.

FIGS. 1-3 show three different embodiments of the connector according to the invention. All the connectors comprise two parts: a receptacle and a plug. The number of leaders for creating an electrical contact between the receptacle and the plug gives name to the connector. A connector having two leaders is accordingly referred to as a T2 connector, one with three leaders a T3 connector and so forth.

In FIG. 1, a T3 connecter comprising a receptacle 100A and a plug 400A is shown. FIG. 2 shows a bended T3 connecter comprising the receptacle 100A being identical to that shown in FIG. 1 and a plug 400B, and FIG. 3 shows the T2 connecter comprising a receptacle 100C and a plug 400C.

Figure 4A:
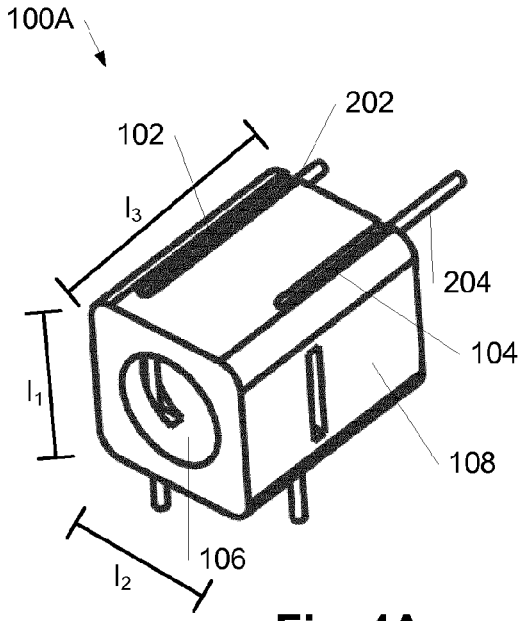
FIGS. 4A-C show the receptacle part of the connector of FIGS. 1 and 2, with FIG. 4B being an exploded view of the receptacle shown in FIG. 4A in a side view, and FIG. 4C being a front view of the receptacle.
Figure 4C:
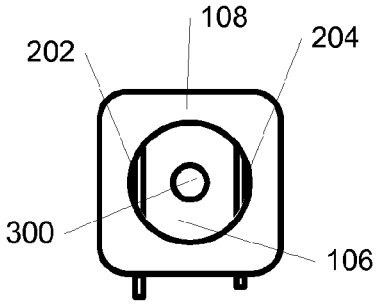
Figure 4B:
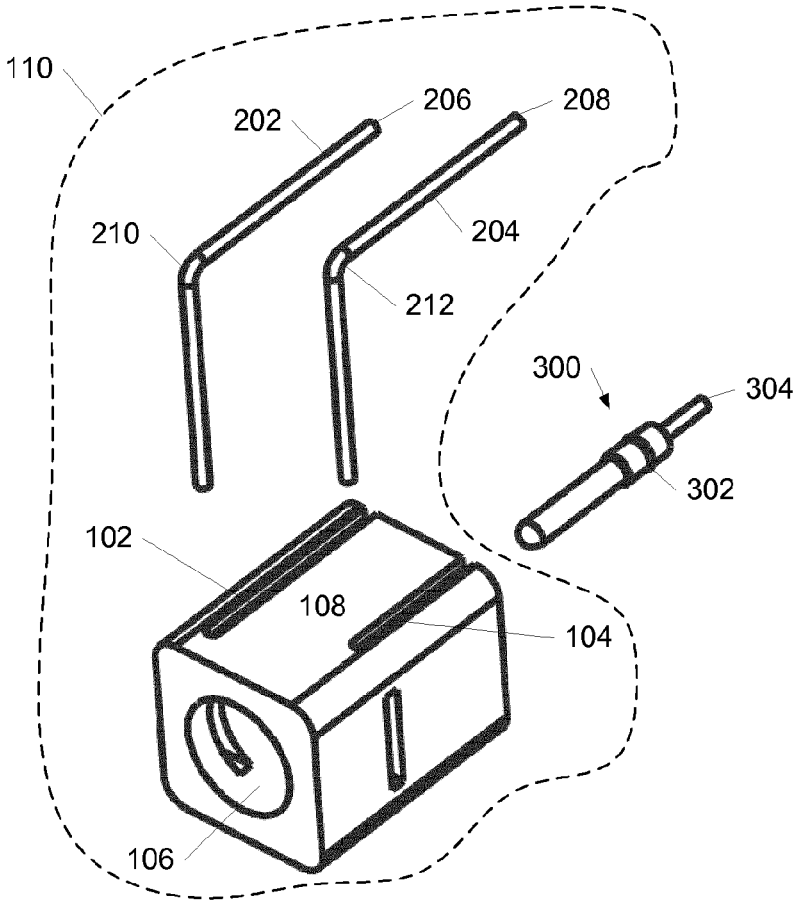

The receptacle 100A present in the two first shown embodiments (FIGS. 1 and 2) is shown in FIGS. 4A-C in more detail with FIG. 4B being an exploded view of the side view in FIG. 4A and FIG. 4C being a front view, where front refers to the side from which the plug is inserted.

The receptacle 100C used in the T2 connector is very similar with only very few differences, which is explained in the following. A close up of the receptacle 100C is thus not shown in the figures.

The receptacle 100A of the (bended) T3 connector comprises a receptacle housing 108, a housing opening 106, a first contact spring 202, a second contact spring 204 and a contact pin 300. The receptacle housing 108 is preferably made of a non-conducting material such as e.g. a heat resistant plastic material and comprises a first receptacle recess 102 adapted to contain the first contact spring 202 and a second receptacle recess 104 adapted to contain the second contact spring 204. In the assembled state shown in FIGS. 4A and 4C, the first contact spring 202 thus fits into the first receptacle recess 102 in the receptacle housing 108, and similarly the second contact spring 204 fits into the second receptacle recess 104 in the receptacle housing 108.

The contact pin 300 and the two contact springs 202, 204 are made of a conducting material, preferably metal. In the assembled state shown in FIGS. 4A and 4C, the contact pin 300 is pressed into the receptacle housing 108 and kept in place by a contact pin retention edge 302 locking the contact pin 300 inside the housing opening 106 as shown in FIG. 4C.

The contact springs 202, 204 and the contact pin 300 are protruding on the rear side of the receptacle housing 108, i.e. the side pointing away from the front where the plug 400A, 400B is inserted. The contact springs 202, 204 and the contact pin 300 may thus be easily electrically connected to electrical contact points in the device, into which the receptacle 100A is mounted, e.g. by soldering. The placement of the rear ends 206, 208, 304 of the contact springs 202, 204 and the contact pin 300 on the same side of the receptacle housing 108 is advantageous if the electrical contact points in the device, into which the receptacle 100A is mounted, are arranged side by side. The contact springs may alternatively protrude from the housing at a different point, e.g. on the side of the receptacle housing 108, if required due to the placement of the contact points in the device, into which the receptacle 100A is mounted.

The contact springs 202, 204 have a bend 210, 212 approximately in the middle of the contact springs, thus giving them an L-shaped design. The simple L-shaped design with only one bend is advantageous as contacts springs having such design can be easyly and inexpensively produced. The L-shaped design further ensures that the contact springs 202, 204 are secured in the recesses 102, 104 in the receptacle housing 108 at the same time as it allows for electrical contact to be easily made between the rear end of contact springs 206, 208 and the contact points in the device, into which the receptacle 100A is mounted.

Alternatively, the contact springs 202, 204 may have an additional bend, thus giving them a U-shaped design. This is useful if the contact springs 202, 204 are to protrude from the housing at a different location than on the rear side of the receptacle housing 108.

The receptacle 100A comprises a so called female receptacle part 110 for receiving a corresponding male plug part, such as e.g. the male plug part 420 of the plug 400A, 400B in FIGS. 5A-B and 6A-B, and a so called male receptacle part for fitting into a corresponding female plug part, such as the first contact tube 500 of plug 400A, 400B in FIGS. 5A-B and 6A-B. The female receptacle part 110 comprises the receptacle housing 108 and the contact springs 202, 204 and the male receptacle part comprises the contact pin 300 situated inside the female receptacle part 110.

The receptacle 100C of the T2 connector differs from the receptacle 100A of the (bended) T3 connector in that it only has a first contact spring 202 and a first receptacle recess 102. Thus, the T2 receptacle 100B lacks the second contact spring 204 and the second receptacle recess 104. Apart from that, the receptacles 100A and 100C of FIGS. 1-3 are identical, and the above description of contact springs and receptacle housing function, design, etc. applies to the receptacle 100C for the T2 connector.

The receptacle housing 108 has in one embodiment an outer dimension of approximately $l_1=l_2=3$ mm and $l_3=4$ mm. The receptacle opening 106 has in one embodiment an inner diameter of approximately $d_1=1.9$ mm. The receptacle pin 300 has in one embodiment a diameter of approximately $d_2=0.4$ mm. This makes the receptacle 100A, 100C in the order of 2-3 times smaller than the commonly known receptacles in the technical field.

Figures 5A, 5B:
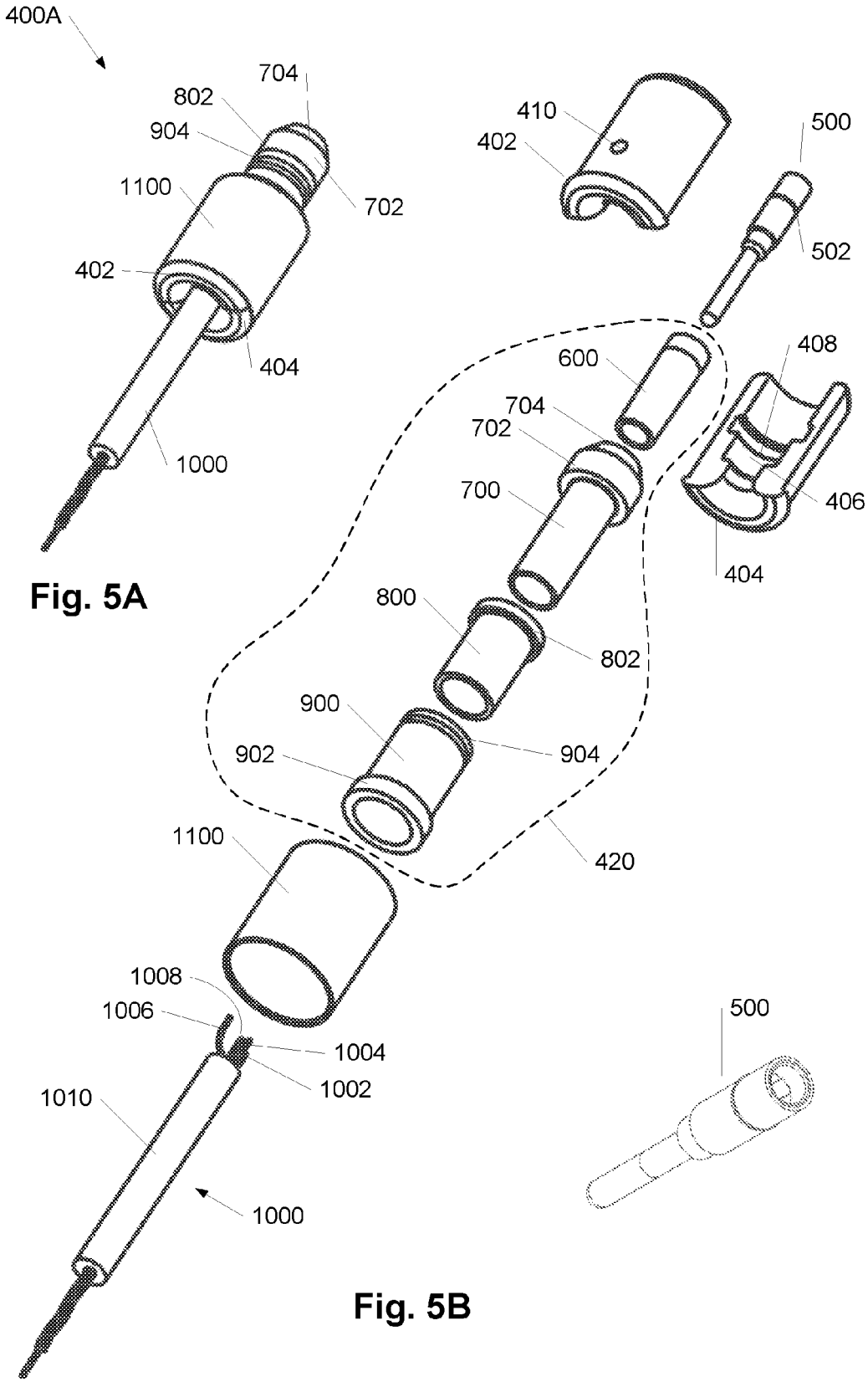
FIGS. 5A-B show the plug part of the connector of FIG. 1 with FIG. 5B being an exploded view.

FIGS. 5A-B show the plug 400A of the T3 connector of FIG. 1 with FIG. 5B being an exploded view of the side view of the assemble plug shown in FIG. 5A. The plug 400A comprises a plug housing consisting of a plug housing top 402 and a plug housing bottom 404, both parts preferably being made in a non-conducting material such as e.g. plastic. In the assembled state shown in FIG. 5A, the plug housing top 402 and bottom 404 together form a plug housing cavity 406 wherein a plug housing groove 408 is found. The plug housing groove 408 can only be seen in FIG. 5B in the plug housing bottom 404, but it should be understood that the plug housing groove 408 likewise is found in the plug housing top 402.

The plug 400A further comprises a first contact tube 500 and a first insulator 600. The first contact tube 500 is preferably made in a conducting material such as e.g. metal. The first contact tube 500 has a first contact retention edge 502 keeping the first contact tube 500 in place inside the first insulator 600 in the assembled state. The first insulator 600 is preferably made in a non-conducting material such as e.g. heat resistant plastic or similar.

In the assembled state shown in FIG. 5A, the first insulator 600 and the first contact tube 500 are pressed into a second contact tube 700. The second contact tube 700 is preferably made in a conducting material such as e.g. metal. Also, the second contact tube 700 has a second contact tube collar 702 encircling the outer part of the second contact tube 700.

In the assembled state, a second insulator 800 is pressed onto the second contact tube 700. The second contact tube collar 702 helps to ensure that the second insulator 800 stays in position. The second insulator 800 is preferably made in a non-conducting material such as heat resistant plastic or similar and comprises a second insulator collar 802, which is pressed against the second contact tube collar 702 in the assembled state.

Surrounding the second insulator 800 is a third contact tube 900 with a third contact tube collar 902 and an integrated third contact tube groove 904. In the assembled state shown in FIG. 5A, the third contact tube collar 902 is pressed against the second insulator collar 802 such that second insulator collar 802 is situated in between the second contact tube collar 702 and the third contact tube groove 904. The third contact tube collar 902 fits into the plug housing groove 408 in the plug housing 402, 404 in the assemble state.

The plug 400A further comprises a cable 1000 comprising a first wire 1002, a second wire 1004, a third wire 1006 and a strength member 1008 enclosed in a jacket 1010, the latter being made of a non-conducting material such as plastic. The wires 1002, 1004, 1006 can be litz wires or similar as described in connection with FIG. 8A-C.

The first wire 1002 is attached to the first contact tube 500, the second wire 1004 is attached to the second contact tube 700, and the third wire 1006 is attached to the third contact tube 900 when the plug is assembled. The attachment of the wires 1002, 1004, 1006 is preferably done by way of soldering.

In the assembled state, the plug assembly comprising the contact tubes 500, 700, 900, the insulators 600, 800, and the cable 1000 is placed into the plug housing bottom 404 such that the third contact tube collar 902 is placed into the plug housing groove 408. The plug housing top 402 is placed on top of the plug assembly inserted in the plug housing bottom 404 such that the plug housing groove 408 in the plug housing top 402 is aligned with the third contact tube collar 902 and the plug housing groove 408 in the plug housing bottom 404.

After the plug housing top 402 and bottom parts 404 have been assembled, the plug housing cavity 406 can advantageously—through a plug housing opening 410—be filled with an adhesive. This secures the strength member 1008 into the plug 400A and prevents the cable 1000 from being pulled out. The adhesive further protects the wires 1002, 1004, 1006 from moisture and corrosion.

At the cable exit end 422, 424 (where the cable 1000 exist the housing 402, 404), the plug housing 402, 404 has a rounded edge. The rounded edge form functions as a strain relief ensuring that the cable 1000 does not easily break at the exit point out of the plug housing 402, 404.

An assembly ring 1100 is pressed onto and over the assemble plug housing top 402 and bottom 404, thereby keeping the plug 400A together. The assembly ring 1100 is preferably made from metal, but could also be made in plastic depending on the requirements to strength, appearance, etc.

Figure 6A:
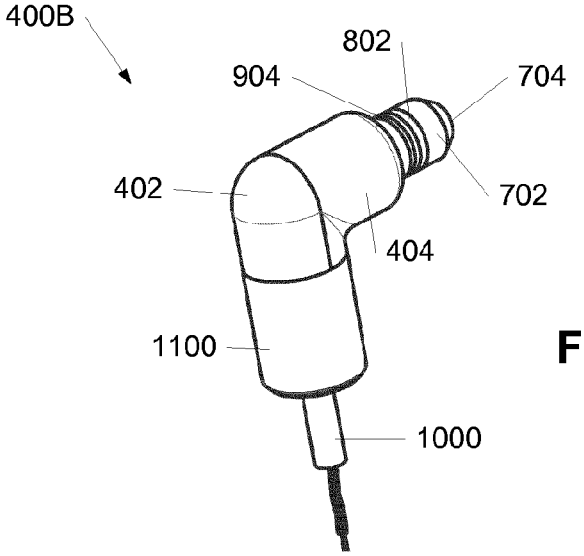
FIGS. 6A-B show the plug in the connector of FIG. 2 with FIG. 6B being an exploded view.
Figure 6B:
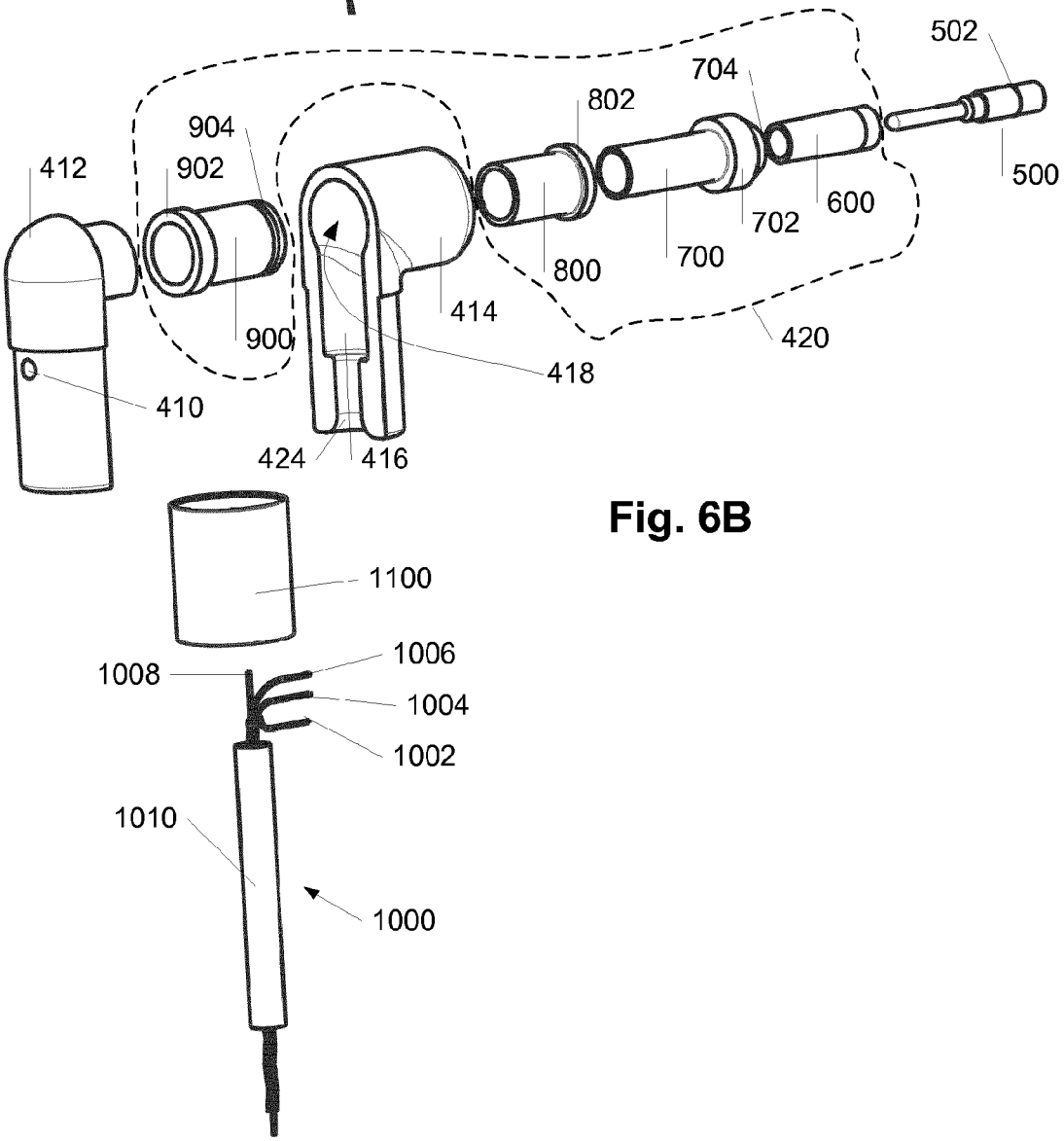

FIGS. 6A-B show the plug 400B of the bended T3 connector shown in FIG. 2 with FIG. 6B being an exploded view of the side view shown in FIG. 6A. The bended T3 connector 400B contains the same elements as the straight T3 connector shown in FIGS. 1 and 5A-B with the only difference being the design of the plug housing, which in this embodiment has a bended shape.

In the bended T3 connector 400B, the housing part contains a bended plug housing front 412 and a bended plug housing back 414. The assembled bended plug housing front 412 and back 414 together form a bended plug housing cavity 416 having a bended shape mimicking the shape of the bended housing as seen from the outside. Inside the bended plug housing back 414 is a bended plug housing groove 418 (not visible in the figure).

The plugs 400A, 400B comprise a so called male plug part 420 for fitting into a corresponding female receptacle part such as the female receptacle part 110 of the receptacle 100A in FIGS. 4A-C. The plugs 400A, 400B further comprise a so called female plug part for accepting a corresponding male receptacle part such as the contact pin 300 of the receptacle 100A in FIGS. 4A-C. The male plug part 420 comprises the second and third contact tubes 700, 900 and the insulators 600, 800, whereas the female plug part is the first contact tube 500.

The T3 connector of FIG. 1 and/or the bended T3 connector of FIG. 2 are assembled by inserting the plug 400A, 400B into the receptacle 100A. The front part 704 of the second contact tube 700 and the second contact tube collar 702 help to guide the plug 400A into the receptacle opening 106. When the plug 400A, 400B is inserted into the receptacle 100A, the first contact spring 202 is pushed in a direction away from the second contact spring 204 until the first contact spring 202 can snap into the third contact tube groove 904, thereby retaining its original shape at the same time as it secures the plug 400A, 400B in the receptacle 100A. This ensures that the plug 400A and receptacle 100A assembly is locked together. In order to unplug the plug 400A and receptacle 100A, a certain force is thus needed.

When the plug 400A, 400B and the receptacle 100A are assembled, the contact pin 300 mounted into the receptacle 100A fits inside the first contact tube 500 of the plug 400A, whereby the two parts are in electrical contact. Likewise, the first contact spring 202 is in electrical contact with the third contact tube 900 as it fits into the third contact tube groove 904, and the second contact spring 204 is in electrical contact with the collar 702 on the second contact tube 700.

The first insulator 600 ensures that there is no electrical connection between the first contact tube 500 and the second contact tube 700. Likewise, the second insulator 800 ensures that there is no electrical contact between the second contact tube 700 and the third contact tube 900.

Figure 7A:
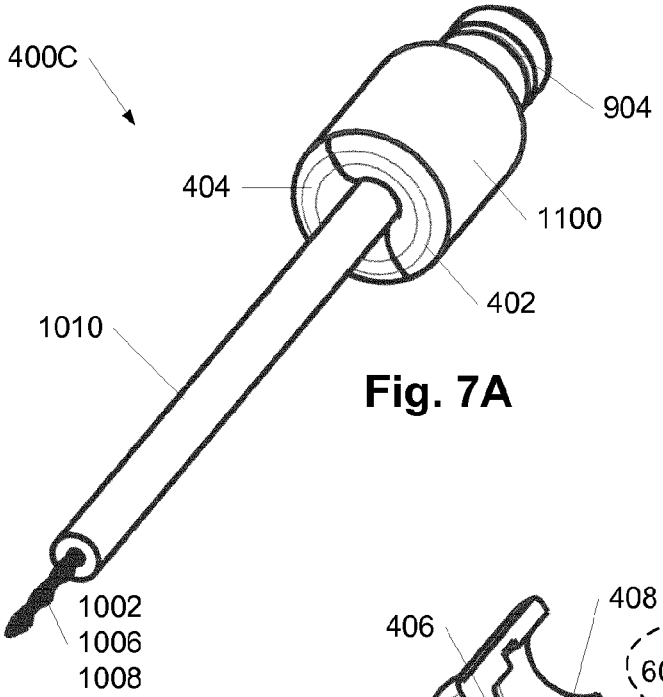
FIGS. 7A-B show the plug in the connector of FIG. 3 with FIG. 7B being an exploded view.
Figure 7B:
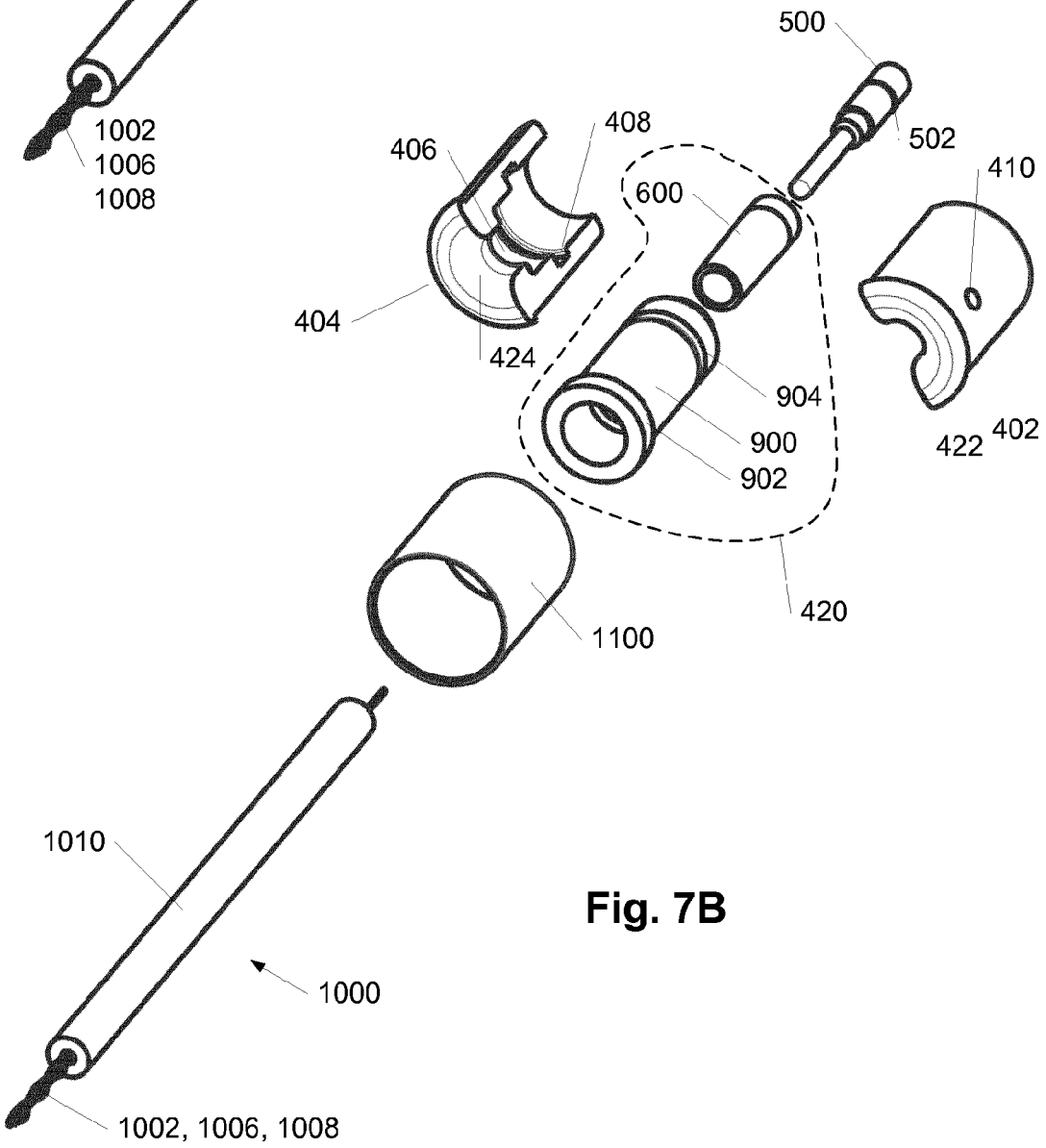

FIGS. 7A-B show the plug 400C in the T2 connector of FIG. 3 with FIG. 7B being an exploded view of the assembled T2 plug in FIG. 7A. The plug 400C of the T2 connector differs from the plug 400A, 400B of the (bended) T3 connector in that it only comprises two contact tubes 500, 900, two wires 1002, 1006 in the cable 1000 and one insulator 600 separating the two contact tubes 500, 900. Otherwise, the individual parts of the T2 plug 400C are assembled and functions in the same way as described above for the (bended) T3 plug 400A, 400B in FIGS. 5A-B and 6A-B.

The T2 plug 400C can also be in the shape of a bended T2 plug constructed in a similar manner as the bended T3 plug 400B in FIGS. 6A-B.

The cable 1000 of the plug 400A, 400B, 400C is not limited to either two or three connecting wires. It could also comprise more wires such as e.g. four, five, six or more wires. These additional wires would in such a case be soldered to additional contacts tubes in the plug thus connecting to corresponding contact parts in the receptacle in a similar way as the wires 1002, 1004, 1006 connect to the contact tubes 500, 700, 900 which again are in electrical contact with the contact springs 202, 204 and the contact pin 300 in the receptacle, when the connector is assembled.

The additional contact tubes in the plug can be male contact tubes or female contact tubes having a similar design as described in connection with the plugs of FIGS. 5A-7B. Likewise, the receptacle may comprise more contacts springs and/or contact pins as described in FIGS. 4A-C for being in contact with the contact tubes of the plug.

The male part 420 of the plugs 400A, 400B, 400C has in one embodiment an outer diameter of approximately 1.9 mm matching the inner diameter of the receptacle opening 106. The plugs 400A, 400B, 400C have in one embodiment a length of approximately 6.6 mm. This makes the plugs 400A, 400B, 400C 2-3 times smaller in size than commonly known 2.5 mm and 3.5 mm micro jack plug part connectors.

Figure 8A:
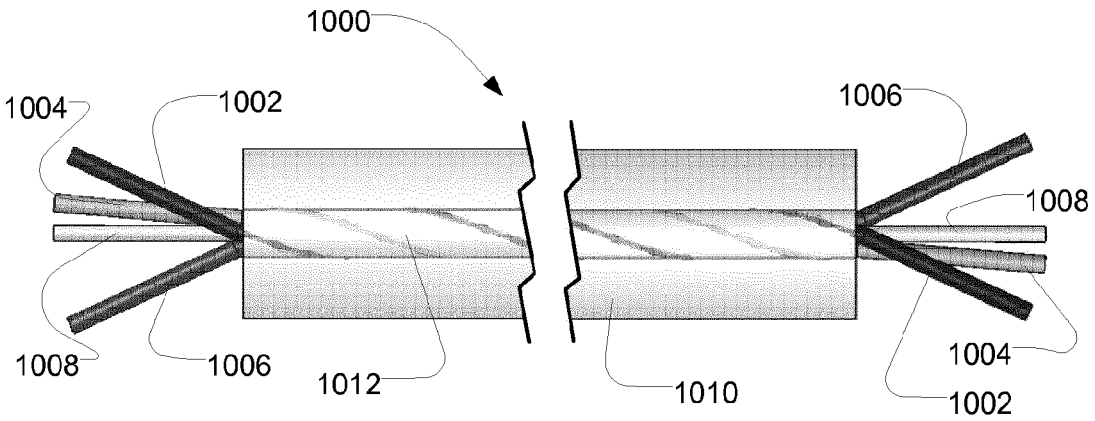
FIGS. 8A-C show close-up views of the cable connected to the plugs of FIGS. 5A-7B.
Figure 8B:
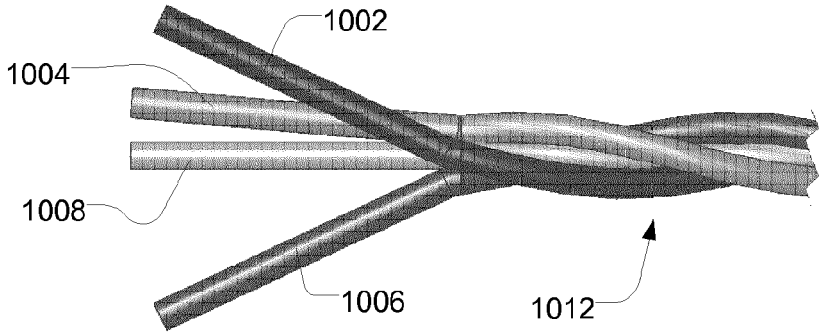

FIG. 8A shows the cable 1000 in a close up view comprising the three wires 1002, 1004, 1006 and the strength member 1008 together constituting a core part 1012, which is surrounded by the outer isolating jacket 1010. The conducting wires 1002, 1004, 1006 can be lacquered and twisted together with the strength member 1008 as shown in FIG. 8B showing the core part 1012 in a close up view.

In FIG. 8A, the cable 1000 is shown with the outer isolating jacket 1010 stripped off the wires 1002, 1004, 1006 in both ends with the wires 1002, 1004, 1006 also being separated in both ends. The ends of the wires 1002, 1004, 1006 can therefore be connected to electrical means, and electrical signals can then be transmitted through each of the wires 1002, 1004, 1006.

The wires 1002, 1004, 1006 are preferably lacquered conducting wires, which are isolated from each other due to a lacquer that covers the conducting part of the conducting wires 1002, 1004, 1006. The consequence is that the conducting wires can be isolated from each other without having an outer isolating jacket made of an isolating material such as nylon, silicone, polyethylene, PVC, Polyamid, polyester, Pebax, etc. around each conducting wire. The outer diameters of the conducting wires 1002, 1004, 1006 are hereby reduced dramatically, and as a result, the outer diameter of the isolating wire 1002, 1004, 1006 is reduced even more.

The flexibility and softness of the isolated wire 1002, 1004, 1006 are further improved as the relatively inflexible and hard outer isolating jackets often used around conducting wires are omitted. The strength member 1008 improves the strength of the cable, and the strength of the cable can be designed to specific specifications by choosing the material of the strength member 1008, by regulating the dimensions of the strength member 1008 or by choosing to have more than one strength member 1008 integrated into the cable 1000. Alternatively, if a very soft and flexible cable is needed, strength members can be omitted.

The cable used in this invention is further less sensitive to noise such as electro mechanical (EM) noise, because the lacquered conducting wires are twisted. Thus, the cable 1000 according to the present invention combines flexibility, softness and strength.

FIG. 8B illustrates one end of the cable 1000 shown in FIG. 8A without the outer isolating jacket 1010. It can be seen that the lacquered conducting wires 1002, 1004, 1006 and the flexible strength member 1008 are twisted together such that they form a helix. The stiffness, softness and strength of the cable 1000 can be modified to fit different customer specifications by varying the materials and dimensions of the cable 1000 and/or the strength member 1008. The strength of the cable 1000 could for instance be increased by adding more strength members 1008, by choosing strength member(s) 1008 made of a strong material and/or by increasing the dimensions of the strength member(s) 1008 and/or the conducting wires 1002, 1004, 1006. The strength member(s) 1008 could for instance be made of heat-resistant and strong synthetic fibers which do not extend in length when stretched. Such fibers could for instance be aramid fibers.

Depending on the stiffness, softness and strength of the cable, it may be suited for applications, where it is placed near skin or near cloth depending on the static electricity created by the different environment it is near.

The thin conducting magnet wires 1002, 1004, 1006 shown in FIGS. 8A-B could e.g. be magnet wires, which are lacquered individually before they are twisted together thus forming a helix. The consequence is that the lacquered conducting wire is very flexible and strong as each magnet wire provides strength to the lacquered conducting wire, and since the magnet wires are lacquered individually they can be displaced relatively to each other which results in a flexible conducting wire.

One or more of the wires 1002, 1004, 1006 shown in FIGS. 8A-B could be colored e.g. by using a colored lacquer and thereby forming a tracer for easy identification of the conducting wire 1002, 1004, 1006. The wires 1002, 1004, 1006 could for instance be magnetic and/or lacquered. The lacquering could be obtained by pulling the wires 1002, 1004, 1006 through a bath comprising the lacquerer, by covering the wires 1002, 1004, 1006 with electrostatic powder which melts when heated or by spray painting the wires 1002, 1004, 1006. The lacquer layer could for instance be polyamide, polyurethane or the like. The lacquered conducting wires 1002, 1004, 1006 thereby form litz wires 1002, 1004, 1006 where each magnet wire 1002, 1004, 1006 is lacquered individually.

Figure 8C:
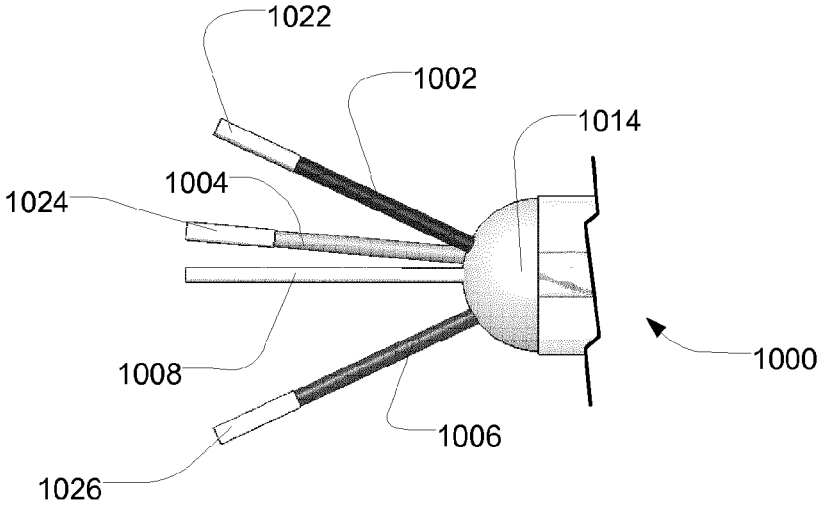

FIG. 8C illustrates another embodiment of a cable 1000 according to the present invention illustrating one end of the cable 1000. The twisted wires 1002, 1004, 1006 and the strength member 1008 have been secured to the outer isolating jacket 1010 by an adhesive 1014. The cable 1000 is hereby made tight because the adhesive 1014 prevents air, moist and dirt from entering the outer jacket 1010. This improves the cable 1000 against corrosion and excludes further sounds from travelling inside the outer isolating jacket 1010.

The adhesive 1014 is further used to secure the cable 1000 in the plug 400A, 400B, 400C e.g. by securing the strength member 1008 to the plug. The wires 1002, 1004, 1006 can as shown in this embodiment be tinned at their ends 1022, 1024, 1026 such that it is ensured, in embodiments where each wire 1002, 1004, 1006 comprises a number of individually lacquered magnet wires (which again are twisted together as described in FIGS. 8A-B), that there is an electrical connection between each lacquered magnet wire in the same litz wire. Alternatively, the electrical connection between the lacquered magnet wires could be established by using conducting adhesive or by melting the magnet wires together. The tinned ends 1022, 1024, 1026 further ensures that each lacquered wire can easily be brazed to the plug 400A, 400B, 400C and thereby create a very good contact between the plug 400A, 400B, 400C and the cable 1000.

The individual wires 1002, 1004, 1006 shown in FIGS. 8A-C could for instance be manufactured by lacquering a number of magnet wires and collecting them in a bundle. Some of the lacquered magnet wires could optionally be colored. The bundle of lacquered magnet wires could then be twisted, thus forming a lacquered conducting wire 1002, 1004, 1006, which optionally comprises colored magnet wires for identification purposes. Seven magnet wires are in one embodiment twisted together with two of these magnet wires being colored. However, any number of magnet wires and/or colored magnet wires could in other embodiments be twisted together.

After manufacturing the individual wires 1002, 1004, 1006, a number of them and a strength member 1008 could be twisted together and an outer jacket extruded around the twisted conducting wires 1002, 1004, 1006 and strength member 1008. In one embodiment of the cable 1000 shown in FIGS. 8A-B, three conducting wires 1002, 1004, 1006—each comprising different colored magnet wires—are twisted together with an aramid fiber acting as the strength member 1008. The cable 1000 thus comprises three lead wires 1002, 1004, 1006, which can easily be identified by their color.

REFERENCES

100A T3 receptacle
100C T2 receptacle
102 first receptacle recess
104 second receptacle recess
106 housing opening
108 receptacle housing
110 female receptacle part
202 first contact spring
204 second contact spring
206 rear end of the first contact spring
208 rear end of the second contact spring
210 bend on the second contact spring
300 contact pin/male receptacle part
302 contact pin retention edge
400A T3 plug
400B bended T3 plug
400C T2 plug
402 plug housing top
404 plug housing bottom
406 plug housing cavity
408 plug housing groove
410 plug housing opening
412 bended plug housing front
414 bended plug housing back
416 bended plug housing cavity
418 bended plug housing groove
420 male plug part
422 cable exit end (housing top 402/housing front 412)
424 cable exit end (housing bottom 404/housing back 414)
500 first contact tube/female plug part
502 first contact tube retention edge
600 first insulator
700 second contact tube
702 second contact tube collar
704 front part of the second contact tube
800 second insulator
802 second insulator collar
900 third contact tube
902 third contact tube collar
904 third contact tube groove
1000 cable
1002 first wire
1004 second wire
1006 third wire
1008 strength member
1010 jacket
1012 core part
1014 adhesive
1022 end of first wire
1024 end of second wire
1026 end of third wire
1100 assembly ring

The invention claimed is:

1. A receptacle for a miniaturized connector for use in an audio device, a hearing device or a similar device, wherein the receptacle comprises:

a first female receptacle part comprising:

a first contact spring a housing part having a front end with a housing opening adapted for receiving a plug;

a rear side pointing away from the front end of the housing, and a first recess adapted to contain the first contact spring, and a first male receptacle part situated inside the first female receptacle part, wherein the first contact spring protrudes all the way through the housing opening in a substantially straight line, wherein a rear end of the first male receptacle part and a rear end of the first contact spring both protrude from the rear side of the housing part.

2. A receptacle according to claim 1, further comprising a second contact spring, wherein the housing part comprises a second recess adapted to contain the second contact spring, the second contact spring protrudes all the way through the housing opening in a substantially straight line.

3. A receptacle according to claim 2, wherein the rear end of the second contact spring protrudes from the rear side of the housing part.

4. A receptacle according to any of claims 3, wherein the first contact spring and/or the second contact spring are L-shaped.

5. A receptacle according to any of claims 2, wherein the first contact spring and/or the second contact spring are L-shaped.

6. A receptacle according to any of claims 1, wherein the first contact spring and/or the second contact spring are L-shaped.

7. A plug for a miniaturized connector for use in an audio device, a hearing device or a similar device, wherein the plug comprises:

a plug housing having a plug housing cavity wherein a plug housing groove is found;

a first male plug part positioned partly inside the plug housing cavity, the first male plug part having a recess at one end and a collar at the other end, the recess being adapted to secure the plug inside a corresponding receptacle, and the collar being adapted for fitting into the plug housing groove;

a first female plug part situated inside the first male plug part; and a first insulator placed between the first female plug part and the first male plug part thereby preventing electrical contact between the two plug parts.

8. A plug according to claim 7 further comprising a cable with at least a first wire and a second wire, wherein the first wire is connected to the first female plug part and a second wire connected to the first male plug part.

9. A plug according to claim 8, wherein the first wire and the second wire are litz wires.

10. A plug according to claim 9, wherein the cable further comprises a strength member and a jacket, wherein the jacket surrounds the at least first and second wires and the strength member.

11. A plug according to claim 8, wherein the cable further comprises a strength member and a jacket, wherein the jacket surrounds the at least first and second wires and the strength member.

12. A plug according to any of the claims 7 further comprising a second male plug part and a second insulator, the second male plug part being placed between the first insulator and the second insulator and the second insulator being placed between the second male plug part and the first male plug part preventing electrical contact between the two male plug parts.

13. A plug according to claim 12, wherein the cable further comprises a third wire, wherein the third wire is connected to the second male plug part.

14. A plug according to any of claims 7, wherein the plug housing comprises a plug housing opening providing access to the plug housing cavity.

15. A miniaturized connector suitable for use in a device, which requires connectors of a size smaller than the commonly known micro jack connectors, i.e. a device such as an audio device, a hearing device or a similar device, the connector comprising a plug and a receptacle wherein the receptacle comprises:

a first female receptacle part comprising:

a first contact spring;

a housing part having a front end with a housing opening adapted for receiving a plug;

a rear side pointing away from the front end, and a first recess adapted to contain the first contact spring; and a first male receptacle part situated inside the first female receptacle part, wherein the first contact spring protrudes all the way through the housing opening in a substantially straight line;

wherein the plug comprises:

a plug housing having a plug housing cavity wherein a plug housing groove is found;

a first male plug part positioned partly inside the plug housing cavity, the first male plug part having a recess at one end and a collar at the other end, the recess being adapted to secure the plug inside a corresponding receptacle, and the collar being adapted for fitting into the plug housing groove; and a first female plug part situated inside the first male plug part; and a first insulator placed between the first female plug part and the first male plug part thereby preventing electrical contact between the two plug parts3, wherein when the connector is assembled;

the first female plug part is in electrical contact with the first male receptacle part situated inside the first female receptacle part; and the first male plug part is in electrical contact with the first contact spring.

16. A miniaturized connector according to claim 15, where the plug comprises the second male plug part and the receptacle comprises the second contact spring, wherein when the connector is assembled the second male plug part is in electrical contact with the second contact spring.

* * * * *